US005121968A

United States Patent [19]

Eppler

[11] Patent Number: 5,121,968

[45] Date of Patent: Jun. 16, 1992

[54] CHAIR, PARTICULARLY OFFICE CHAIR

[75] Inventor: Richard Eppler, Artlishalde, Fed. Rep. of Germany

[73] Assignee: Wilhelm Link GmbH & Co. KG, Tieringen, Fed. Rep. of Germany

[21] Appl. No.: 497,407

[22] Filed: Mar. 22, 1990

[30] Foreign Application Priority Data

Nov. 30, 1989 [DE] Fed. Rep. of Germany ... 8914098[U]

[51] Int. Cl.[5] ..... A47C 3/00

[52] U.S. Cl. ..... 297/300; 297/301; 297/302; 297/304

[58] Field of Search ..... 297/300, 301, 302, 304

[56] References Cited

U.S. PATENT DOCUMENTS 2,471,024 5/1949 Cramer ..... 297/301
2,894,563 7/1959 Simons et al. ..... 297/304
3,042,448 7/1962 Hamilton ..... 297/301

*Primary Examiner*—Laurie K. Cranmer
*Assistant Examiner*—Milton Nelson, Jr.
*Attorney, Agent, or Firm*—Michael J. Striker

[57] ABSTRACT

A chair, particularly an office chair, comprises a chair column, a seat lower frame supported on the chair colunm in a height-adjustable manner and rotatable relative to a vertical axis, a seat support supported on the seat lower frame turnably about a horizontal axis, a backrest support supported on the seat lower frame turnably about a horizontal axis, at least one spring with adjustable tensioning and supported on the seat lower frame and the backrest support, an adjustable abutment provided for the pressure spring, a control curve against which the adjustable abutment abuts, and an adjusting element arranged to displace the control curve.

2 Claims, 3 Drawing Sheets

CHAIR, PARTICULARLY OFFICE CHAIR

BACKGROUND OF THE INVENTION

The present invention relates to a chair, particularly to an office chair. More specifically, it relates to such a chair which has a chair column or vertical support, a seat lower frame which is arranged on the chair column in a height adjustable manner and also rotatably about a vertical axis, a seat support and a backrest support arranged on the seat lower frame rotatably about a horizontal axis, and at least one pressure spring supported on the seat lower frame and the backrest support with an adjustable tensioning.

Chairs of the above mentioned general type are known in the art. Such chairs can be further improved so as to perform an adjustment of the force with which the pressure spring acts on the backrest support, in a simple and space-economical manner.

SUMMARY OF THE INVENTION

Accordingly, it is an object of the present invention to provide a chair, particularly an office chair, which is a further improvement of the existing chairs.

More particularly, it is an object of the present invention to provide a chair, particularly an office chair, in which the adjustment of the pressure spring which acts on the backrest support is performed in a simple and space-economical manner.

In keeping with these objects and with others which will become apparent hereinafter, one feature of the present invention resides, briefly stated, in a chair in which an adjustable abutment for the pressure spring abuts against a control curve which is adjustable by means of an adjusting element.

When the chair is designed in accordance with the above specified features, it improves the existing construction in the manner explained.

In accordance with another advantageous feature of the present invention, the control curve is formed as a control track in a rotatably supported control curve support.

The control curve support can be rotatably supported on the backrest support or on the chair column, in accordance with further features of the present invention.

When the control curve support is supported on the chair column, the pressure spring is provided on its supporting end with an additional abutment which cooperates with the backrest support.

In accordance with a preferable embodiment of the invention, the control track is formed as a spiral track in a disc-shaped control curve support. The disc-shaped control curve support is supported on the backrest support parallel to its pivot axis and rotatable by means of the adjusting element. In this embodiment a compact and less spatial control curve support is provided, which permits a stepless adjustment of the force of the pressure spring.

The spiral track in accordance with a further embodiment can extend over at least a full spiral convolution and provided for a sufficiently great adjustment region.

In accordance with still another feature of the present invention, the control curve support can be arranged so that it can be adjusted by a user of the chair through a rotary handle manually, for example underneath the chair seat.

On the other hand, the rotatably supported control curve support can be coupled with an adjusting element through a torsion cable, and the adjusting element can be arranged in a grip region of a person sitting on the chair.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
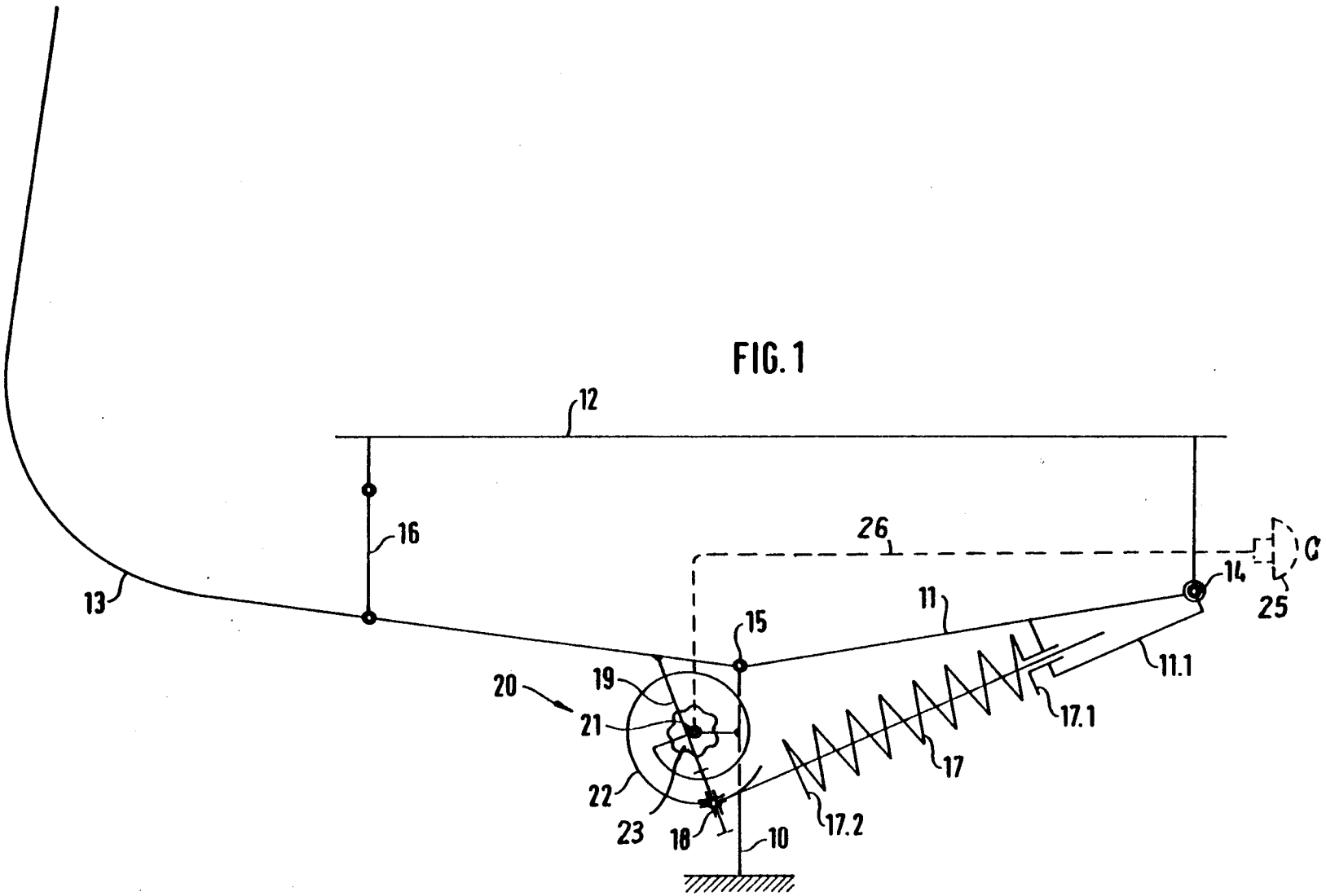
FIG. 1 is a schematic link diagram of a chair in accordance with the invention.

A chair in accordance with the present invention which is schematically shown in a link diagram on FIG. 1 has a chair column 10 shown in a broken line, a seat lower frame 11 rotatably supported on the chair column, a seat support 12 arranged above the seat lower frame, and a curved backrest support 13.

The seat support 12 is pivotally connected with the seat lower frame 11 at its front end in a point 14. The backrest support 13 is linked to the seat lower frame 11 in a point 15. The rear end of the seat support 12 is connected with the backrest support 13 through a link 16. A pressure spring 17 is arranged under the seat lower frame 11.

The pressure spring 17 has one end 17.1 which is connected with a part 11.1 of the seat lower frame 11. It also has another end 17.2 which is connected with an abutment 18. The latter is coupled with a displaceable control curve support 20. In the selected embodiment the control curve (cam) support 20 is rotatably supported on an arm 19 of the backrest support 13 about an axle 21.

The control curve support 20 which is shown in FIG. 1 only schematically has a control curve (cam) 22 in form of a spiral. The abutment 18 of the pressure spring 17 engages in the above mentioned spiral.

Figure 2:
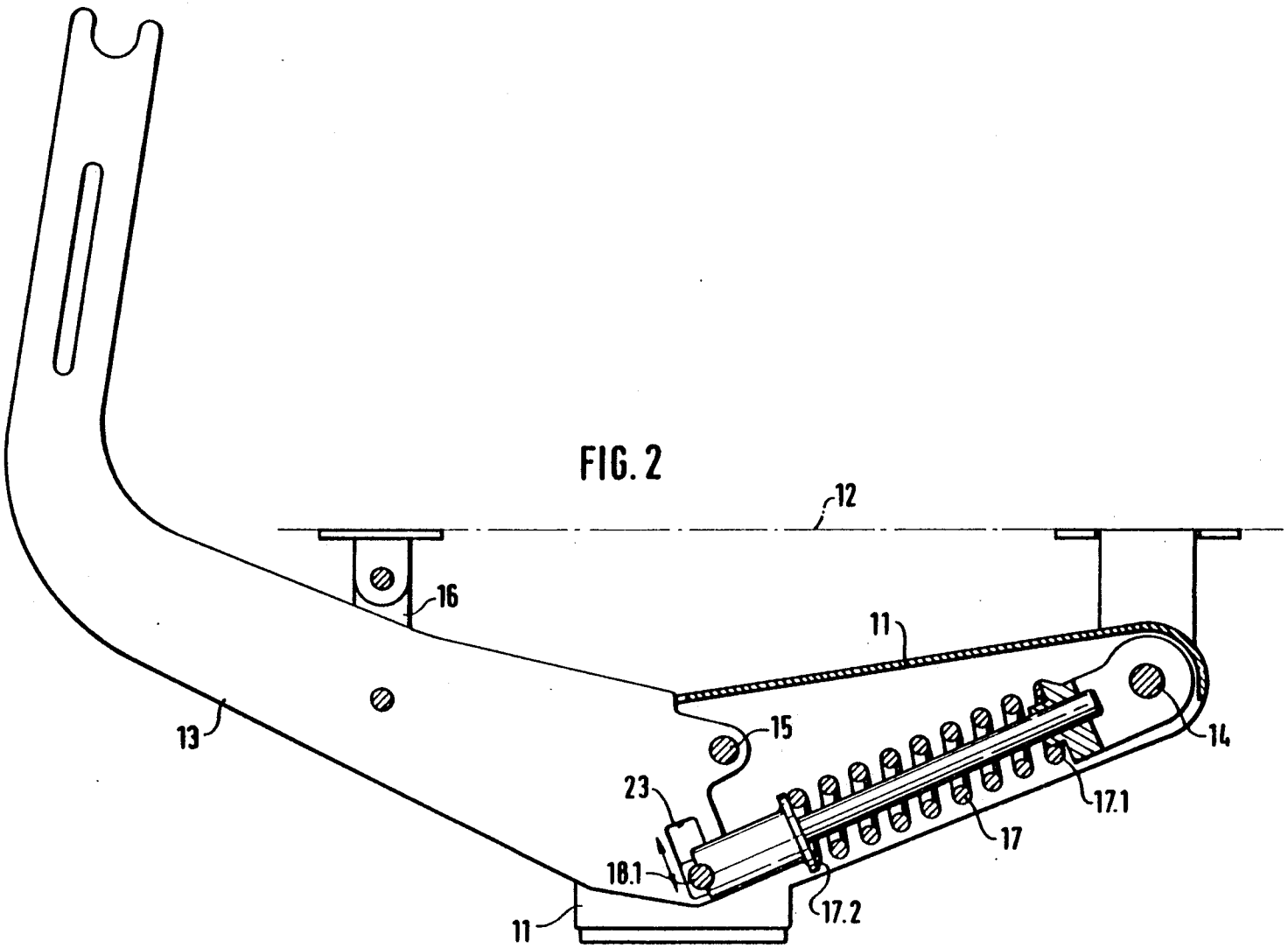
FIG. 2 is a side view of a construction of the chair parts shown in the diagram of FIG. 1 with a section through a seat lower frame.
Figure 3:
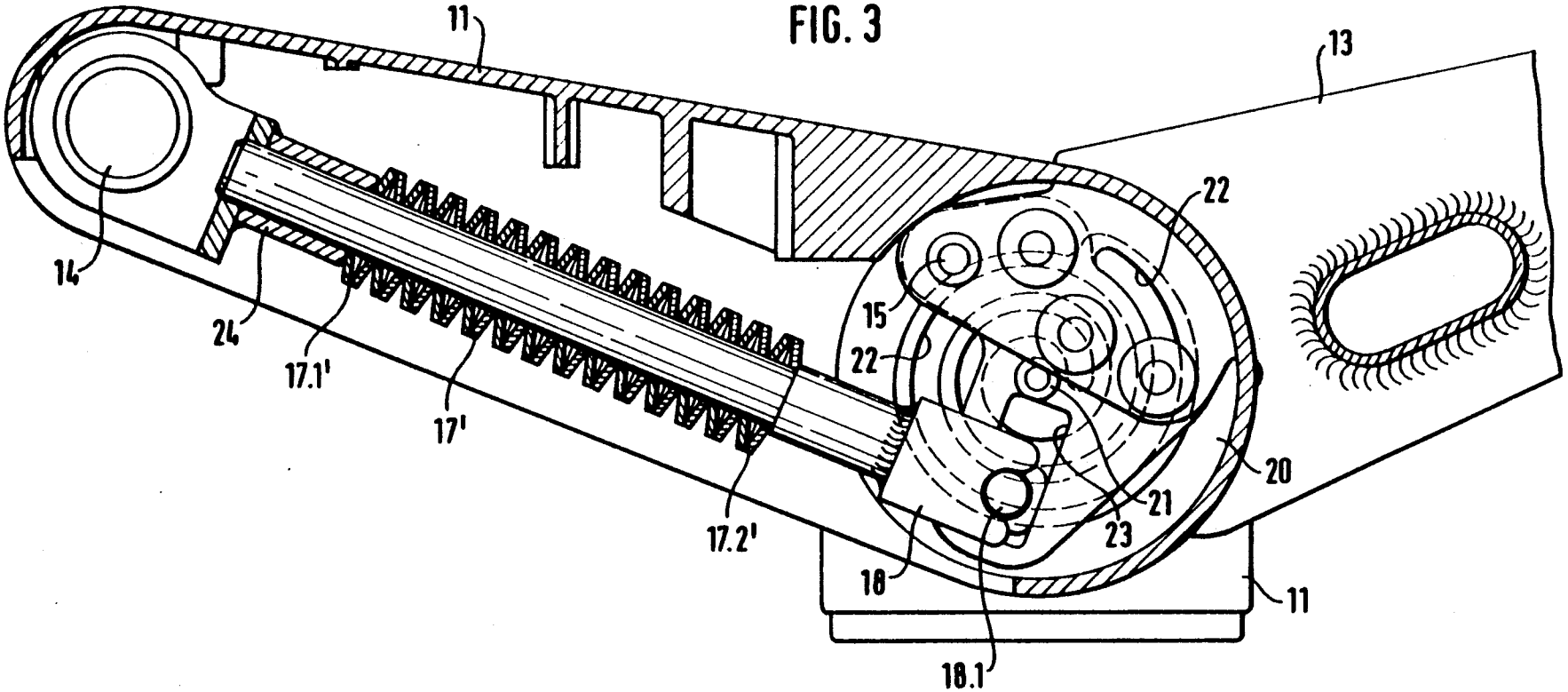
FIG. 3 is a view showing details of FIG. 2 on an enlarged scale, in a section taken through the seat lower frame of the chair.

FIG. 2 shows the construction of the parts illustrated in FIG. 1. FIG. 3 shows further details of the construction and also illustrates the control curve support 20. In both structural embodiments in accordance with FIGS. 2 and 3, the control curve support 20 is supported on the seat lower part rotatably about the axle 21. It is composed of a disc body in which a spiral shaped control track 22 is milled. A pin 18.1 connected with the abutment 18 of the pressure spring 17 or 17' engages in the control track 22. The pin 18.1 extends through a window 23 formed in the backrest support 13 and then into the control track 22. It forms also an abutment for the backrest support.

By turning of the disc-shaped control curve support 20, it is possible to adjust the position of the abutment 18 relative to another abutment 24 of the pressure spring 17', which is anchored on a stationary turning axle 14. Thereby the pretensioning of the pressure spring 17 can be changed. The turning of the control curve support about the axle 21 can be performed by means of an adjusting element formed as a rotary handle 23 which is directly coupled with it, or as a rotary handle 25 coupled with it through a torsion spring or cable 26.

It will be understood that each of the elements described above, or two or more together, may also find a useful application in other types of constructions differing from the types described above.

While the invention has been illustrated and described as embodied in a chair, particularly an office chair, it is not intended to be limited to the details shown, since various modifications and structural changes ma be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A chair, particularly an office chair, comprising a chair column; a seat lower frame supported on said chair column in a height-adjustable manner and rotatable relative to a vertical axis; a seat support supported on said seat lower frame turnably about a first horizontal axis; a backrest support supported on said seat lower frame turnably about a second horizontal axis; at least one spring with adjustable tensioning and supported on said seat lower frame and said backrest support; an adjustable abutment provided for said spring; a control curve provided for abutting said adjustable abutment thereagainst and operative for adjusting said abutment for said spring and thereby tensioning of said spring; and an adjusting element arranged to displace said control curve so as to adjust said abutment for said spring and thereby the tensioning of said spring; and a rotatably supported control curve support, said control curve being formed as a control track in said rotatably supported control curve support, said control track being formed as a spiral track in a disc-shaped control curve support, said disc-shaped control curve support being supported parallel to said second horizontal axis and rotatable by said adjusting element, said spiral track extending over at least one full spiral convolution.

2. A chair, particularly an office chair, comprising a chair column; a seat lower frame supported on said chair column in a height-adjustable manner and rotatable relative to a vertical axis; a seat support supported on said seat lower frame turnably about a first horizontal axis; a backrest support supported on said seat lower frame turnably about a second horizontal axis; at least one spring with adjustable tensioning and supported on said seat lower frame and said backrest support; an adjustable abutment provided for said spring; a control curve provided for abutting said adjustable abutment thereagainst and operative for adjusting said abutment for said spring and thereby tensioning of said spring; and an adjusting element arranged to displace said control curve so as to adjust said abutment for said spring and thereby the tensioning of said spring said control track being formed as a spiral track in a disc-shaped control curve support, said disc-shaped control curve support being supported parallel to said second horizontal axis and rotatable by said adjusting element.

* * * * *